US008388117B2

(12) United States Patent
Keenan et al.

(10) Patent No.: US 8,388,117 B2
(45) Date of Patent: Mar. 5, 2013

(54) METHOD OF MAKING AN INKJET PRINTHEAD

(75) Inventors: Phil Keenan, Lucan (IE); Pat MacDermott, Kildare (IE); Kevin Dooley, Wicklow (IE); Gerard Lowe, Meath (IE); Barry Fitzgerald, Dublin (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 2111 days.

(21) Appl. No.: 11/041,969

(22) Filed: Jan. 26, 2005

(65) Prior Publication Data

US 2006/0033784 A1 Feb. 16, 2006

(30) Foreign Application Priority Data

Jan. 29, 2004 (GB) ..... 0401877.6

(51) Int. Cl.
*B41J 2/045* (2006.01)
*B41J 2/05* (2006.01)
*B41J 2/015* (2006.01)

(52) U.S. Cl. ..... 347/71; 347/65; 347/20

(58) Field of Classification Search ..... 347/65, 347/20, 71
See application file for complete search history.

(56) References Cited

U.S. PATENT DOCUMENTS

| | | | | |
|---|---|---|---|---|
| 6,364,455 | B1 * | 4/2002 | Yang et al. | 347/47 |
| 6,766,817 | B2 | 7/2004 | Da Silva | |
| 2002/0044171 | A1 * | 4/2002 | Hirahara et al. | 347/46 |
| 2002/0071006 | A1 | 6/2002 | Chen et al. | |
| 2003/0143444 | A1 * | 7/2003 | Liu et al. | 429/19 |

FOREIGN PATENT DOCUMENTS

| | | | |
|---|---|---|---|
| EP | 0641659 | B1 | 1/1998 |
| EP | 1226944 | A1 | 7/2002 |
| EP | 1380422 | A1 | 1/2004 |
| JP | 4-161341 | | 6/1992 |
| JP | 05-124205 | A | 5/1993 |
| JP | 7-137263 | | 5/1995 |
| JP | 08-336976 | A | 12/1996 |
| JP | 2000-094695 | | 4/2000 |
| JP | 2000-108360 | | 4/2000 |
| JP | 2002-59557 | A | 2/2002 |

OTHER PUBLICATIONS

Japanese Office Action, Feb. 6, 2008, JPO.

* cited by examiner

*Primary Examiner* — Stephen Meier
*Assistant Examiner* — Sarah Al Hashimi

(57) ABSTRACT

A method of making an inkjet printhead comprises forming a first patterned layer 20 on a surface of a first substrate 10, forming a second patterned layer 28 on a surface of a second substrate 100, bonding the first and second layers in intimate face-to-face contact, and removing the second substrate 100 from the second patterned layer 28. The first and second patterned layers 20, 28 together define at least one ink ejection chamber having at least one ink ejection nozzle.

3 Claims, 4 Drawing Sheets

METHOD OF MAKING AN INKJET PRINTHEAD

TECHNICAL FIELD

This invention relates to a method of making an inkjet printhead.

BACKGROUND ART

Inkjet printers operate by ejecting small droplets of ink from individual orifices in an array of such orifices provided on a nozzle plate of a printhead. The printhead may form part of a print cartridge which can be moved relative to a sheet of paper and the timed ejection of droplets from particular orifices as the printhead and paper are relatively moved enables characters, images and other graphical material to be printed on the paper.

A typical conventional printhead is fabricated from a silicon substrate having thin film resistors and associated circuitry deposited on its front surface. The resistors are arranged in an array relative to one or more ink supply slots in the substrate, and a barrier material is formed on the substrate around the resistors to isolate each resistor inside a thermal ejection chamber. The barrier material is shaped both to form the thermal ejection chambers, and to provide fluid communication between the chambers and the ink supply slot. In this way, the thermal ejection chambers are filled by capillary action with ink from the ink supply slot, which itself is supplied with ink from an ink reservoir in the print cartridge of which the printhead forms part.

The composite assembly described above is typically capped by a metallic nozzle plate, usually nickel, having an array of drilled orifices which correspond to and overlie the ejection chambers. The printhead is thus sealed by the nozzle plate, but permits ink flow from the print cartridge via the orifices in the nozzle plate.

The printhead operates under the control of printer control circuitry which is configured to energise individual resistors according to the desired pattern to be printed. When a resistor is energised it quickly heats up and superheats a small amount of the adjacent ink in the thermal ejection chamber. The superheated volume of ink expands due to explosive evaporation and this causes a droplet of ink above the expanding superheated ink to be ejected from the chamber via the associated orifice in the nozzle plate.

Many variations on this basic construction will be well known to the skilled person. For example, a number of arrays of orifices and chambers may be provided on a given printhead, each array being in communication with a different coloured ink reservoir. The configurations of the ink supply slots, printed circuitry, barrier material and nozzle plate are open to many variations, as are the materials from which they are made and the manner of their manufacture.

The typical printhead described above is normally manufactured simultaneously with many similar such printheads on a large area silicon wafer which is only divided up into individual printhead dies at a late stage in the manufacture. FIG. 1 is a plan view of the front surface of a substantially circular silicon wafer 10 typically used in the manufacture of printheads. The wafer 10 has a large number of slots 12 each extending fully through the thickness of the wafer. In FIG. 1 the slots 12 are grouped in threes, as would be the case where the wafer is to be used in the manufacture of printheads for colour printing. The rear surface (not seen in FIG. 1) of the wafer 10 has grooves running vertically between each group of three slots 12 and horizontally between each row of slots 12 so that ultimately the wafer can be divided up, for example, using a conventional dicing saw into individual "dies" each containing one group of three slots 12. The slots 12 are conventionally formed by laser machining or sand blasting, usually from the rear surface of the wafer.

In the final printhead each slot 12 supplies ink to one or more ink ejection chambers disposed along one or both sides of the slot on the front surface of the wafer. Although, for reasons of mass production, the ink supply slots 12 are almost always formed in the undivided wafer 10, they can be formed at any of a number of different stages of production. However, although the slots 10 can formed in the initial "raw" wafer, as seen in FIG. 1, it is preferred to form the slots when the front surface of the wafer already bears the thin film resistors and other circuitry. This is because an unslotted wafer presents an uninterrupted front surface for the application and patterning of the various layers forming the thin film circuitry. If the slots were present they would need to be temporarily blocked off, for example, in the manner disclosed in our European Patent Application No. EP 1,297,959, or other measures would need to be taken to avoid leaving undesired materials in the slots.

However, if the slots are formed when the front surface of the wafer already bears the thin film circuitry, the latter needs to be covered with a protective coating to avoid damage to the delicate and critical thin film structures. A coating of polyvinyl alcohol (PVA) is conventionally used to protect these structures. Alternatively, a protective sol gel glass coating can be used as disclosed in our copending patent application.

Conventionally, each printhead nozzle plate is applied individually to the undivided wafer on a die-by-die basis, i.e. individual metallic nozzle plates are applied to respective underlying portions of the wafer which will correspond in the subsequently divided wafer to individual printhead dies. However, techniques currently used typically only allow the nozzle plates to be aligned to an accuracy of +/−4 microns per die. This can lead to non-uniform drop ejection and corresponding poor performance of the final printhead. In addition, the metal nozzle plate does not bond well to the underlying barrier layer which is usually a patterned photoresist. Polyimide nozzle plates are also known, but again they are applied individually to the undivided wafer on a die-by-die basis and suffer from the same alignment and bonding problems as metallic nozzle plates.

It is also known from our European Patent Application No. EP 1,297,959 to employ a single photoresist layer applied across the entire surface of the wafer to form both the barrier layer and the nozzle plates by selective exposure of the photoresist to different depths. When the exposed photoresist is developed three-dimensional voids are formed in the layer which define the ink ejection chambers and nozzles. However, this can provide unsatisfactory results and often leaves debris in the ink chambers which can be difficult to remove.

It is an object of the invention to provide an improved method of making an inkjet printhead in which, at least in certain embodiments, these disadvantages are avoided or mitigated.

DISCLOSURE OF THE INVENTION

The invention provides a method of making an inkjet printhead comprising a method of making an inkjet printhead, comprising forming a first patterned layer on a surface of a first substrate, forming a second patterned layer on a surface of a second substrate, bonding the first and second layers in intimate face-to-face contact, and removing the second substrate from the second patterned layer, the first and second layers together defining at least one ink ejection chamber having at least one ink ejection nozzle.

As used herein, the terms "inkjet", "ink supply slot" and related terms are not to be construed as limiting the invention to devices in which the liquid to be ejected is an ink. The terminology is shorthand for this general technology for printing liquids on surfaces by thermal, piezo or other ejection from a printhead, and while the primary intended application is the printing of ink, the invention will also be applicable to printheads which deposit other liquids in like manner.

Furthermore, the method steps as set out herein and in the claims need not necessarily be carried out in the order stated, unless implied by necessity.

BRIEF DESCRIPTION OF THE DRAWINGS

In the drawings, which are not to scale, the same parts have been given the same reference numerals in the various figures.

DESCRIPTION OF PREFERRED EMBODIMENT

Figure 1:
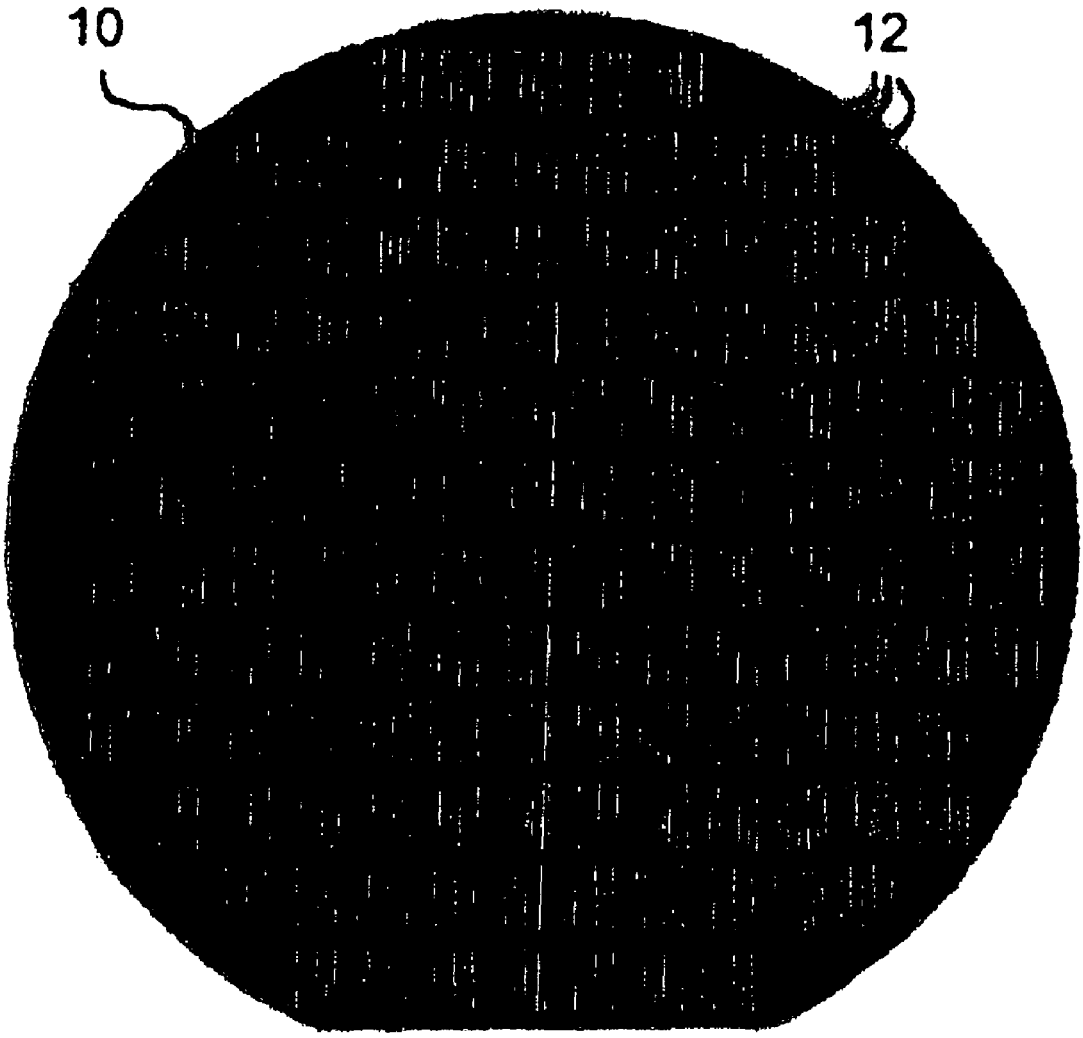
FIG. 1, previously described, is a plan view of a silicon wafer used in the manufacture of printheads according to an embodiment of the invention.
Figure 2A:
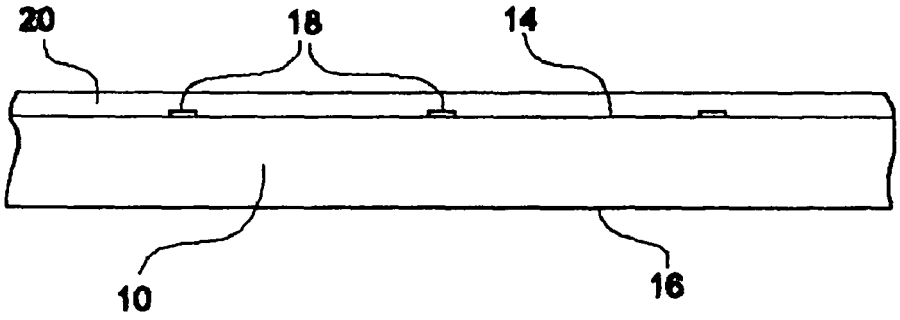
FIGS. 2A to 2G show successive steps in making a printhead according to an embodiment of the invention.

FIG. 2A shows, in fragmentary cross-sectional side view, a substantially circular silicon wafer 10 of the kind previously referred to and typically used in the manufacture of conventional inkjet printheads. In this embodiment the wafer 10 has a thickness of 675 μm and a diameter of 150 mm. The wafer 10 has opposite, substantially parallel front and rear major surfaces 14 and 16 respectively, the front surface 14 being flat, highly polished and free of contaminants in order to allow ink ejection elements to be built up thereon by the selective application of various layers of materials in known manner.

The first step in the manufacture of a printhead according to the embodiment of the invention is to process the front surface 14 of the wafer in conventional manner to lay down thin film ink ejection circuitry of which, for the sake of avoiding overcomplicating the drawings, only the thin film heating resistors 18 are shown. These resistors 18, in the embodiment, are connected via conductive traces to a series of contacts which are used to connect the traces via flex beams with corresponding traces on a flexible printhead-carrying circuit member (not shown) mounted on a print cartridge. The flexible printhead-carrying circuit member enables printer control circuitry located within the printer to selectively energise individual resistors under the control of software in known manner. As discussed, when a resistor 18 is energised it quickly heats up and superheats a small amount of the adjacent ink which expands due to explosive evaporation.

Next, a blanket barrier layer 20 of a photoresist, for example SU-8, is spin coated onto the front surface 14 of the wafer to a thickness of 14 microns, covering the entire front surface of the wafer including the thin film circuitry.

Figure 2B:
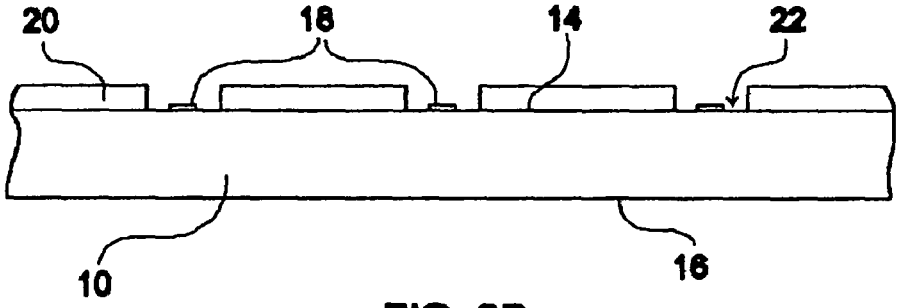

The photoresist 20 is now soft baked by placing the wafer on a hotplate at 65 deg. C. The hotplate is fitted with proximity pins and the distance between the wafer and the hotplate is reduced from 5 mm to contact over a period of 9 minutes to reduce stress formation in the photoresist. The blanket layer 20 is now imaged by exposure through a photomask with an exposure energy of between 400-500 mj.cm$^{-2}$, and developed using PGMEA, NMP or Ethyl Lactate. The result is shown in FIG. 2B where the now patterned barrier layer 20 has regions 22 which have been selectively removed to define, in the finished printhead, the lateral boundaries of a plurality of ink ejection chambers 24, FIGS. 2G, 3 and 4. The formation of the barrier layer is part of the state of the art and is familiar to the skilled person.

Figure 3:
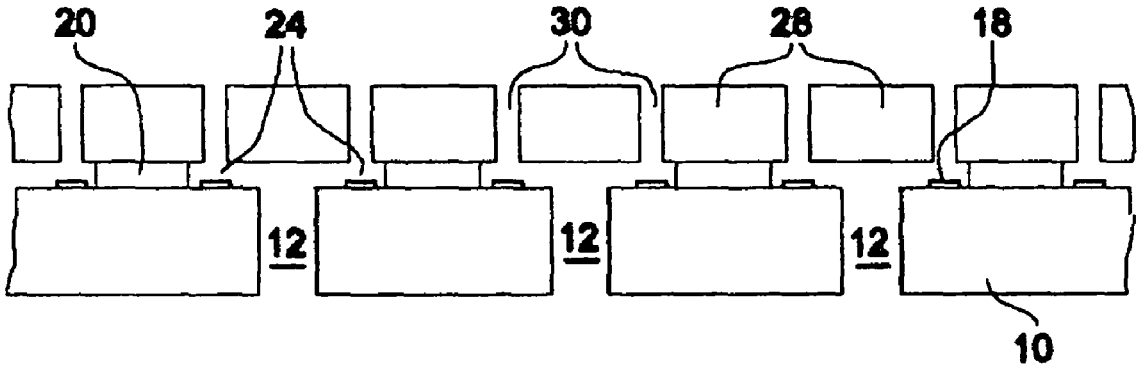
FIG. 3 is a cross-section taken on line X-X of FIG. 2G.
Figure 4:
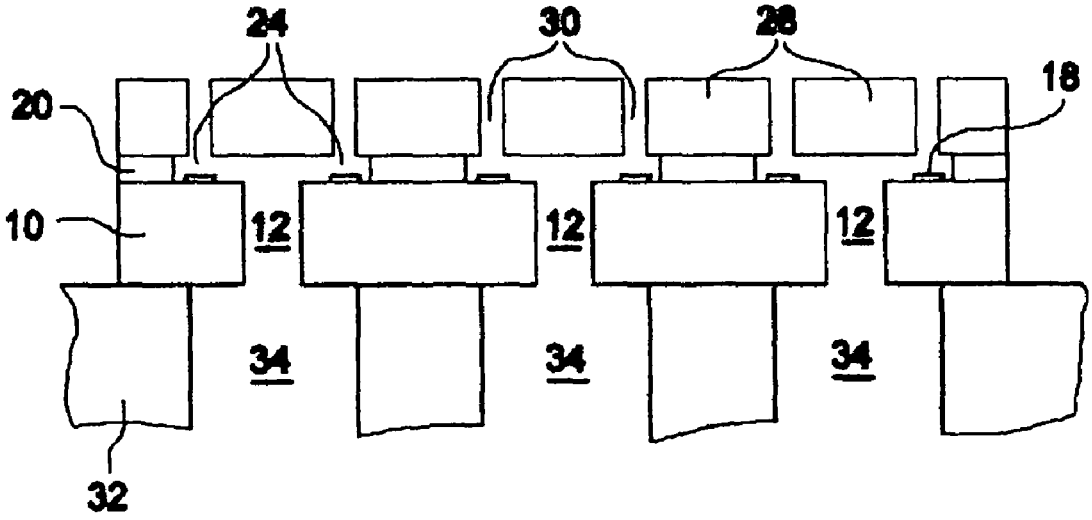
FIG. 4 is a cross-sectional view of a print cartridge incorporating a printhead made by the method of FIGS. 2A to 2G.

At this stage the ink supply slots 12 are formed in the wafer 10. The ink supply slots are not shown in FIGS. 2A to 2G since in those figures the cross-sections are taken between and parallel to the slots 12. However, the slots 12 are seen in FIGS. 3 and 4. The slots 12 can be formed by laser machining, wet etching, sand blasting or other conventional method, and their formation needs no further description here.

Figure 2C:
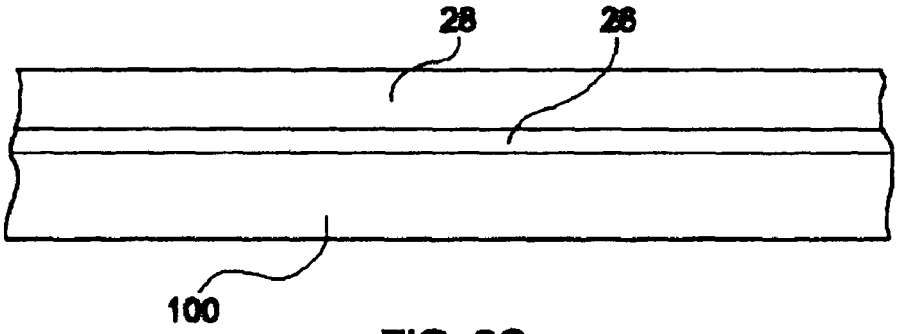
Figure 2D:
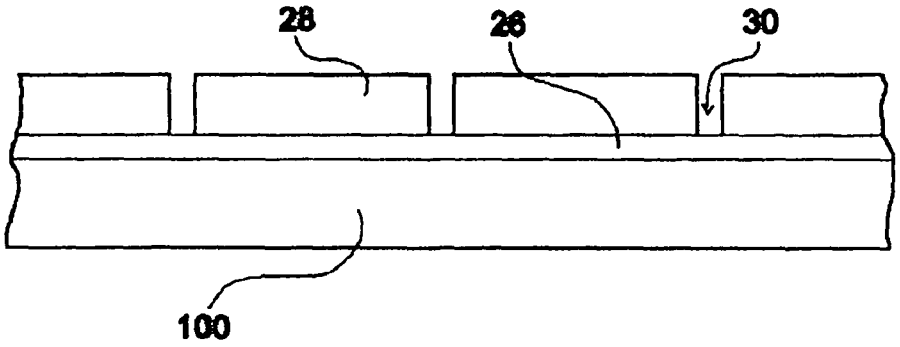

Next, FIG. 2C, a lift-off layer of a thermal release tape 26 is laminated onto the front surface of a second silicon wafer 100 having dimensions substantially the same as the wafer 10. In this embodiment the tape 26 is Revalpha thermal release tape manufactured by Nitto Denko (alternatively, PMG1 lift-off resist can be used). Now, a blanket layer 28 of a photoresist, for example SU-8 but in any case preferably the same photoresist used for the barrier layer 20, is spin coated onto the tape 26 to a thickness of 49 microns, covering the entire surface of the tape 26 on the front surface of the wafer 100.

The photoresist layer 28 is now soft baked, selectively exposed and developed in the manner previously described for the barrier layer 20, although with due adjustment of the process parameters to take account of the greater thickness of the layer 28. For example, the exposure energy used for the layer 28 is much greater than that used for the layer 20 and the exposure duration is from 1.5s to 3s. The result is that the layer 28 is patterned to define a plurality of openings 30 which, in the finished printhead, will form nozzles for the ink ejection chambers 24.

Figure 2E:
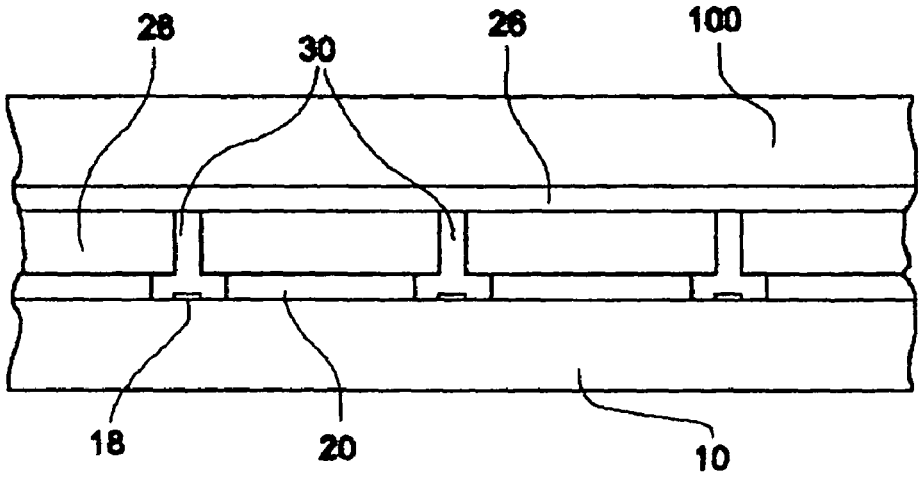
Figure 2F:
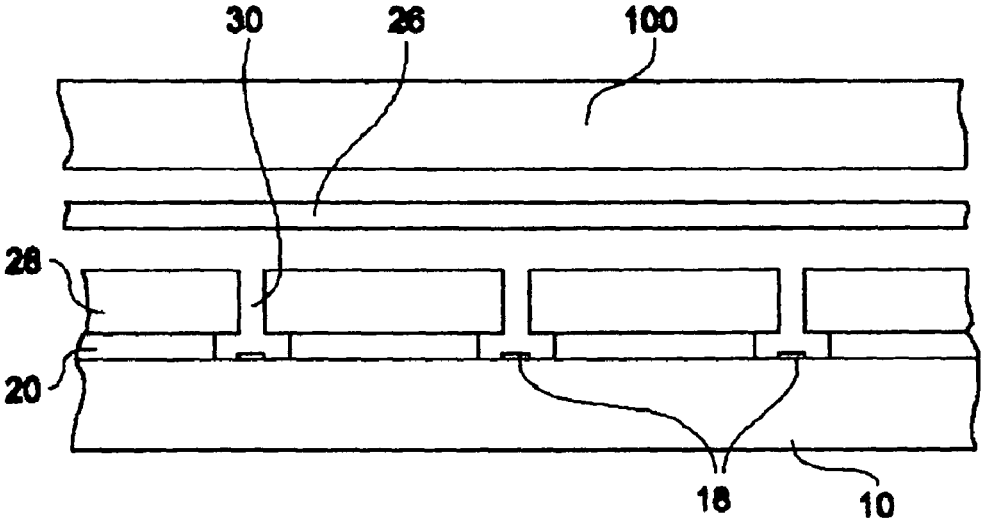

Next, FIG. 2E, the wafers 10 and 100 are clamped together with the photoresist layers 20, 28 in face-to-face contact, each nozzle 30 being directly in register with a respective resistor 18. The wafer alignment is done using an EV 620 aligner to align respective fiducials on the two wafers.

The EV 620 alignment tool has two sets of pre-aligned lenses and cameras for aligning the top and bottom wafers to be bonded. The left and right top cameras are accurately aligned to the left and right bottom cameras. Firstly the bottom wafer is introduced to the camera region with its alignment targets facing upwards and the alignment targets aligned to the left and right top cameras. The bottom wafer's alignment position is then recorded from the wafer's stage encoders and the wafer is then entirely withdrawn from the alignment region. The top wafer is now introduced to the alignment region with its alignment targets facing downwards. The wafer is then aligned to the left and right bottom cameras. Finally the bottom wafer is re-introduced to the alignment region and moved to its previously recorded alignment coordinates. Thus both the bottom wafer is accurately aligned to the top wafer. The top wafer is then lowered until it is in contact with the bottom wafer and the two wafers then clipped together to retain alignment while the wafer pair is transferred to the bonding tool.

The photoresist 20, 28 layers are now intimately bonded together by baking the wafers at 100 deg. C. at 2000N in a vacuum of 10−3 mbar using an EVG 520 wafer bonder manufactured by EVG, Shaerding, Austria. While still in the bonder the temperature of the wafers is ramped to 150 deg. C. which boils the adhesive in the Revalpha thermal release tape so that the tape 26 and substrate 100 are released from the nozzle layer 28. At the same time the photoresist becomes hard baked.

Figure 2G:
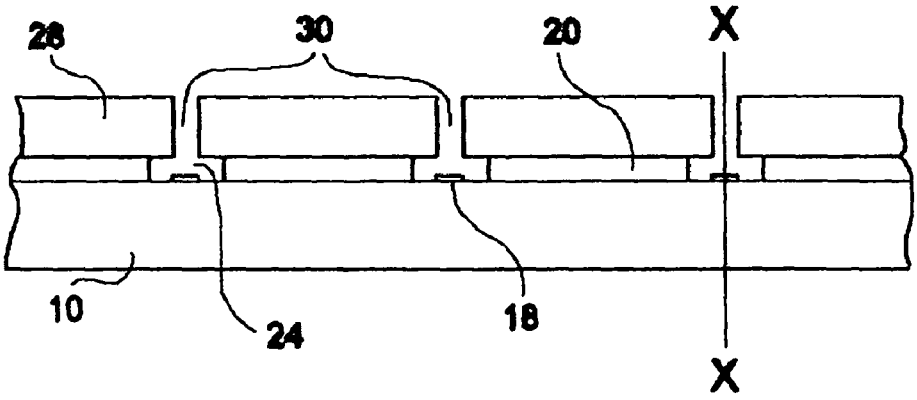

The final composite structure, FIGS. 2G and 3, comprises a plurality of ink ejection chambers 24 disposed along each side of each slot 12 although, since FIG. 3 is a transverse cross-section, only one chamber 24 is seen on each side of each slot 12. The patterned barrier layer 20 defines the lateral boundaries of the chambers 24, while the nozzle layer 28 defines the roof of the chambers. Each chamber 24 contains a respective resistor 18 and an ink supply path extends from the slot 12 to each resistor 18. Finally, a respective ink ejection nozzle 30 leads from each ink ejection chamber 24 to the exposed outer surface of the nozzle layer 28.

Finally, the wafer processed as above is diced to separate the individual printheads from the wafer and each printhead is mounted on a print cartridge body 32, FIG. 4, having respective apertures 34 for supplying ink from differently coloured ink reservoirs (not shown) to the printhead. To this end the printhead is mounted on the cartridge body 32 with each aperture 34 in fluid communication with a respective slot 12 in the wafer 10.

Although the slots 12 in each group of three slots are shown as disposed side by side, they could alternatively be disposed end to end or staggered or otherwise offset without departing from the scope of this invention. Also, in the case of a printhead which uses a single colour ink, usually black, only one ink supply slot 12 will be required per printhead.

The use of semiconductor lithography in the manufacture of the nozzles in the above embodiment makes it much easier to maintain tight tolerances on the nozzles, typically less than +/−1.0 micron. Also, since the nozzles are aligned on a whole wafer basis, rather than on a die-by-die basis, nozzles and resistors can be typically aligned to better than +/−2.0 microns across the whole wafer. This results in better drop ejection uniformity and printhead performance. Finally, the use of photoresist for both the nozzle layer and barrier layer results in good bonding between the two.

The invention is not limited to the embodiment described herein and may be modified or varied without departing from the scope of the invention.

What is claimed:

1. An inkjet printhead made by a method comprising:

forming a first patterned layer with a first opening on a surface of a first substrate;

forming a second patterned layer with a second opening narrower than the first opening on a surface of a second substrate;

bonding the first and second layers in intimate face-to-face contact; and removing the second substrate from the second patterned layer, the first and second layers together defining at least one ink ejection chamber with an overhang defined by the second patterned layer, the chamber having at least one ink ejection nozzle.

2. A print cartridge comprising a cartridge body having an aperture for supplying ink from an ink reservoir to a printhead, and a printhead as claimed in claim 1, wherein the second patterned layer is bonded to the surface of the second substrate by a layer of a thermal release material, and the second substrate is removed from the second patterned layer by heating the thermal release material, wherein the printhead is mounted on the cartridge body with the aperture in fluid communication with an ink supply opening in the printhead.

3. An inkjet printer including a print cartridge according to claim 2.

* * * * *